United States Patent [19]

Wirz

[11] Patent Number: 4,856,426

[45] Date of Patent: Aug. 15, 1989

[54] SHEET-FED ROTARY PRINTING MACHINE WITH PRINTING UNITS ARRANGED IN TANDEM

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 738,587

[22] Filed: May 28, 1985

[30] Foreign Application Priority Data

May 26, 1984 [DE] Fed. Rep. of Germany ..... 3419762

[51] Int. Cl.[4] ..... B41F 7/06

[52] U.S. Cl. ..... 101/217; 101/230

[58] Field of Search ..... 101/230, 420, 217, 232

[56] References Cited

U.S. PATENT DOCUMENTS

| | | | |
|---|---|---|---|
| 517,908 | 4/1894 | Wendte | 101/174 |
| 2,804,417 | 8/1957 | Cross et al. | 101/420 X |
| 3,334,892 | 8/1967 | Janecek et al. | 101/420 X |
| 3,796,154 | 3/1974 | Weisgerber | 101/230 X |
| 4,024,814 | 5/1977 | Becker | 101/230 X |
| 4,060,238 | 11/1977 | Simeth | 101/420 X |
| 4,165,689 | 8/1979 | Giuiuzza | 101/230 |
| 4,188,883 | 2/1980 | Schone et al. | 101/230 X |
| 4,378,734 | 4/1983 | Wirz | 101/230 |

*Primary Examiner*—Charles A. Pearson

*Attorney, Agent, or Firm*—Herbert L. Lerner; Laurence A. Greenberg

[57] ABSTRACT

Sheet-fed rotary printing machine having printing units arranged in tandem for processing both paper as well as cardboard with single-side multicolor or first form and perfector printing and having at least one sheet-turning device, each of the printing units having four cylinders consisting, in addition to a plate and a blanket cylinder of given diameter, of an impression cylinder and a transfer cylinder each having double the diameter of the respective plate and blanket cylinders, includes a base frame located between two of the printing units and carrying only two cylinders consisting of a transfer cylinder and a storage cylinder, each having a diameter double that of the respective plate and blanket cylinders, the one of the two printing units located downstream of the base frame in travel direction of a sheet through the printing machine having a transfer cylinder in the form of a sheet-turning cylinder with respective rows of tongs-grippers disposed 180° from one another around the circumference thereof, the base frame and the one of the two printing units together constituting a sheet-turning device, the impression cylinder of the one of the two printing units being in cooperative engagement with the turning cylinder and having hook grippers thereon for taking over a sheet from the tongs grippers of the turning cylinder, and means disposed on the impression and turning cylinder as well as the transfer and storage cylinders for transporting the sheet smudge-free with the printed surface thereof facing radially inwardly on the cylinders.

9 Claims, 1 Drawing Sheet

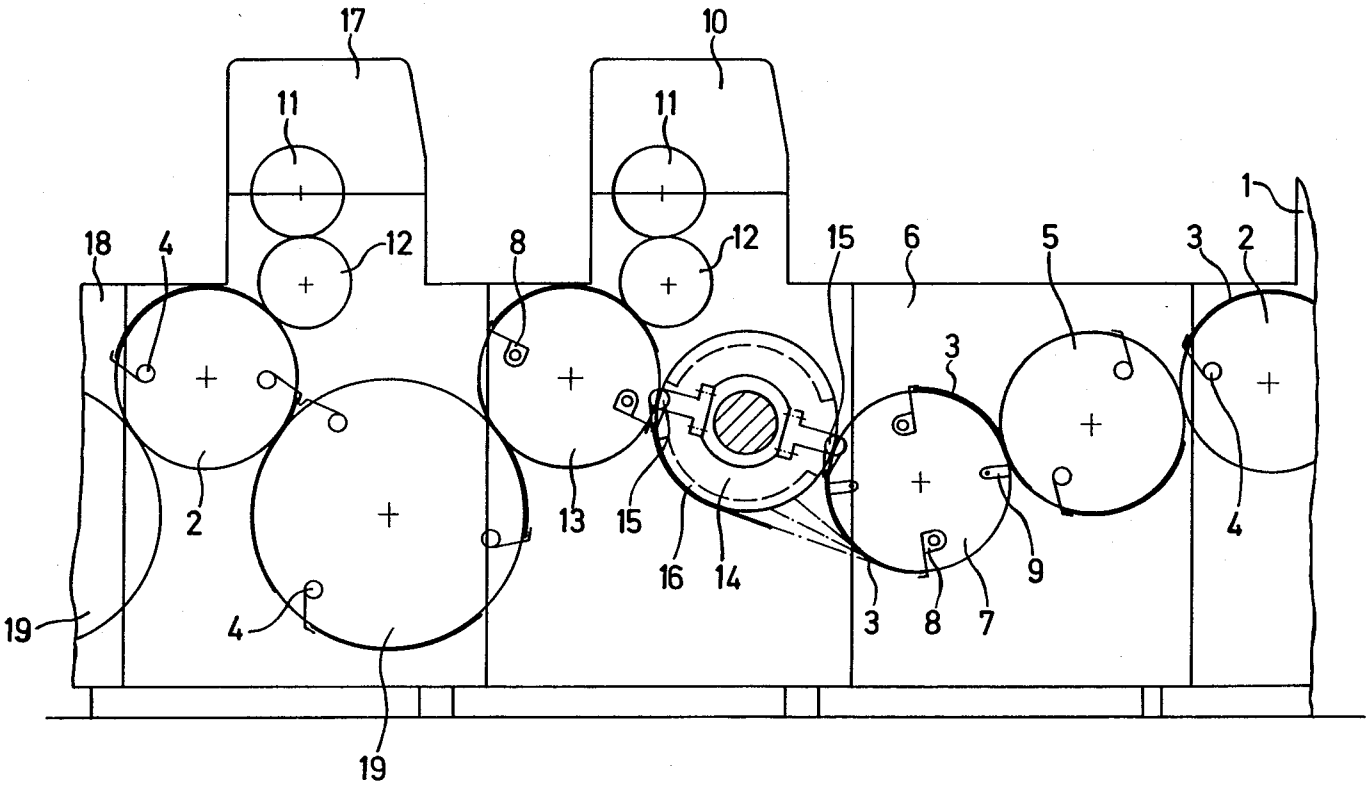
1
2
3
4
5
6
7
8
9
10
11
12
13
14
15
16
17
18
19

SHEET-FED ROTARY PRINTING MACHINE WITH PRINTING UNITS ARRANGED IN TANDEM

The invention relates to a sheet-fed rotary offset printing press having printing units arranged in tandem or series for printing both on paper as well as cardboard with a single-side multicolor or first form and perfector printing process and having at least one sheet turning device, each printing unit being formed of an impression cylinder and a transfer drum in addition to a plate cylinder and a blanket cylinder, the impression cylinder and the transfer drum having double the given diameter of the plate cylinder and blanket cylinder, respectively.

A multicolor sheet-fed rotary printing press of the type outlined hereinabove is already known from German Published Non-Prosecuted Application (DE-OS) No. 24 52 167. The impression cylinder of each printing unit in this press and a sheet turning or turnover cylinder arranged between two of the printing units are double the given diameter. At the tangential point of the two cylinders, a sucker system provided on the turnover or turning cylinder engages the trailing edge of the freshly printed sheet lying on the smooth sheet-carrying surface of the impression cylinder. After moving or swinging in within the circumference of the turning or turnover cylinder, the sucker system transfers the engaged trailing edge of the sheet to a gripper system which then swings out again during the course of the remaining rotary movement of the turning or turnover cylinder, and then presents the trailing edge of the sheet to the gripper system of the next following impression cylinder. The sucker system is constructed as part of a coupled double rocker arm to achieve a sheet transfer while maintaining the sheet in correct register.

Although the relatively large diameters of the sheet-guiding cylinders ensure that the heretoforeknown multicolor sheet-fed rotary printing presses are basically suitable for the processing of cardboard, the fact that the trailing edge of the sheet has to be lifted off the smooth counterpressure or impression surface of the impression cylinder by means of a sucker system means that, despite the use of a double rocker arm, the trailing part of the sheet becomes creased unavoidably during the process of transferring the trailing edge of the sheet to the gripper system of the turnover cylinder with the result that cardboard can be processed only at low speed ranges, if at all. This is because the aforementioned creasing of the trailing edge of the sheet particularly at higher press output rates, causes the sheet to tear away from the sucker system, namely, due to the stiffness of the cardboard. Furthermore, print-free areas for press-on segments must be provided with this sheet turning or turnover system.

A sheet-turning or turnover device for rotary printing presses having an in-tandem or in-series is furthermore known from German Published Prosecuted Application (DE-AS) No. 2 305 132 wherein the impression cylinders of successive printing units are linked by a single transfer drum. To turn the sheet, two pairs of gripper systems formed of two interacting rows of clamping grippers are provided in the impression cylinder, following the transfer drum in the direction of sheet transport. The printing cylinder and the transfer drum have double the diameter of the plate and blanket cylinders. Suction boxes are provided above the transfer drum and lift the sheet to be turned slightly off the surface of the transfer drum the instant a row of clamping grippers of the next impression cylinder has engaged the trailing edge of the sheet. During the turning process i.e. while the trailing edge of the sheet is being transferred from one gripper system to the other, the sheet to be turned is kept taut by the suction boxes. Although the suction boxes pneumatically engage or apply suction to the non-printed side of the sheet, the instant that the gripper system of the impression cylinder, following the turning process, detach the then trailing edge of the sheet from the suction box, the printed underside of the sheet may strike either the surface of the transfer drum or the cylindrical surface of the impression cylinder then carrying the sheet, thereby unavoidably smudging the printed image. In addition to this drawback, the use of two rows of grippers, which come into action each time a sheet is turned, means that the trailing edge of the sheet can hardly be transferred without becoming creased. In the case of thicker board, this would result in permanent, unacceptable deformation. Furthermore, greatly curved or bowed board edges result in operational disruption because they strike the edges of the following grippers, preventing correct engagement of a board.

Finally, a sheet-fed rotary printing press having a set or unit type of construction is known from German Published Non-prosecuted Application (DE-OS) No. 26 39 900 and has a device for alternative single side or first form and perfector printing and includes a module or component as an independent unit which is arranged between the like printing units, the module having a transfer drum and a following turnover or turning cylinder. The transfer drum operates in conjunction with one or two drying devices.

In this heretofore known module or unit, the sheet is also quite obviously pneumatically engaged or has suction applied thereto by the gripper devices of the turning or turnover cylinder on the cylindrical surface of the transfer drum and passed on to other gripper devices for the purpose of being turned. As mentioned further hereinabove, it is impossible to prevent thicker cardboard edges from becoming creased in this process. Provision also must be made for detaching or tearing away the cardboard from the suction system. Above and beyond this, the drying installations represent considerable expense. They require no small amount of energy. A particular disadvantage of the drying installations is, moreover, that they are employed in the middle of the printing process and tend to heat up the associated cylinders. Excessive heating can lead to stresses in printed very thin sheets having a large area, resulting in errors of register, particularly because, in first form and perfector printing ¼, drying takes place after printing of the single-color perfector impression and before the application of the multicolor first form printing.

It is accordingly an object of the invention to provide a high-performance sheet-fed rotary printing press for single-side multicolor and for first form and perfector printing capable of ensuring smudge-free and damage-free in-register processing of stock ranging from paper through thick cardboard.

With the foregoing and other objects in view, there is provided in accordance with the invention, a sheet-fed rotary printing machine having printing units arranged in tandem for processing both paper as well as cardboard with single-side multicolor or first form and perfector printing and having at least one sheet-turning device, each of the printing units having four cylinders consisting, in addition to a plate and a blanket cylinder of given diameter, of an impression cylinder and a transfer cylinder each having double the diameter of the respective plate and blanket cylinders, comprising a base frame located between two of the printing units and carrying only two cylinders consisting of a transfer cylinder and a storage cylinder, each having a diameter double that of the respective plate and blanket cylinders, the one of the two printing units located downstream of the base frame in travel direction of a sheet through the printing machine having a transfer cylinder in the form of a sheet-turning cylinder with respective rows of tongs-grippers disposed 180° from one another around the circumference thereof, the base frame and the one of the two printing units together constituting a sheet-turning device, the impression cylinder of the one of the two printing units being in cooperative engagement with the turning cylinder and having hook grippers thereon for taking over a sheet from the tongs grippers of the turning cylinder, and means disposed on the impression and turning cylinder as well as the transfer and storage cylinders for transporting the sheet smudge-free with the printed surface thereof facing radially inwardly on the cylinders.

The relatively large diameters of all sheet-carrying cylinders and drums favor in-register transport of the sheets. The use of tongs-grippers interacting with the storage drum and the hook-grippers of the printing cylinder following the turnover or turning cylinder enable a sheet to be passed on during the turning process without creasing or damaging the sheet edge. Excessive waste is thereby avoided. Stoppages due to creased sheet edges are also eliminated. The measures taken to effect non-smudging transport of the sheets obviate the need for a drying device having a high energy consumption and possible sheet-deforming effects.

A simple base frame for carrying a transfer cylinder and a storage cylinder then represents no especially great expense if the transfer cylinder and storage cylinder, as well as the turnover or turning cylinder are, in any case, employed in other standard printing press models having an in-line or in-tandem type of construction and can be utilized without modification. The only features which are required to be produced specially are two very simple side panels for mounting the sheet turning or turnover device.

In accordance with another feature of the invention, the impression cylinder of the one of the two printing units has cylindrical surfaces conducive to transferring ink which is applied thereto.

In accordance with a further feature of the invention, the surfaces conducive to ink transfer are on coverings of the cylindrical surface.

Coverings of the foregoing general type have been disclosed in German Published Non-Prosecuted Applications (DE-OS) No. 24 46 188 and (DE-OS) No. 29 16 505.

In accordance with alternative features of the invention, the sheet-carrying surfaces of the transfer drums and of the turnover cylinders are either provided with closed cylindrical surfaces conducive to transferring ink which is applied thereto or equipped with rods and bearing elements, for example small rollers. For processing stiff cardboard, there is also, however, the possibility of dispensing with sheet-supporting and sheet-guiding elements altogether for both the transfer cylinders and the turning or turnover cylinders. This is possible because the sheet-guiding drums and cylinders are of at least double the diameter of the plate and blanket cylinders.

In accordance with an additional feature of the invention, the respective transfer and turning cylinders have removable shells forming guide surfaces for sheets being printed. These shells are employed when processing paper, especially very light-weight papers. If stiffer sheets, e.g. cardboard, however, are to be printed, the shells can be removed from the transfer and turnover cylinders because, in such a case, sheet-guiding elements are superfluous. An advantage thereof is that the outer cylindrical surfaces of the shells, which are conducive to ink transfer, do not need to be washed frequently. The selective employment of such shells thus enables the printer to plan more favorable setting-up times.

In accordance with a concomitant feature of the invention, all of the printing units except the one of the two printing units forming part of the sheet-turning device have respective transfer cylinders with a diameter triple that of the respective plate and blanket cylinders.

Other features which are considered as characteristic for the invention are set forth in the appended claims.

Although the invention is illustrated and described herein as embodied in a sheet-fed rotary printing machine with printing units arranged in tandem, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments in which the single figure of the drawing is a diagrammatic elevational view of a cardboard printing press for single-side multicolor printing, convertible to first form and perfector printing.

Referring now to the figure of the drawing, it is noted that, in the interest of clarity and simplification, feeder and delivery systems are not shown therein. Furthermore, one of the printing units thereof, namely the printing unit 1, is only partially shown. An impression cylinder 2 of the printing unit 1 passes a sheet 3 on to a following transfer drum 5 by means of conventional clamping grippers 4. The impression cylinder 2 and the transfer drum 5 are double the diameter of conventional plate and blanket cylinders 11 and 12 of the press. The transfer drum 5 is mounted in a simple base frame 6 which also serves to support a storage drum 7. The storage drum 7 takes over the sheet 3 from the transfer drum 5 by means of a row of hook-grippers 8 carried thereby. The transferred sheet 3 is tautened or stretched out on the storage drum 7 by means of tensioning suckers 9 so that the trailing edge of the sheet 3 assumes a given position corresponding to the suitably oriented leading edge.

The simple base frame 6 is followed by a printing unit 10 which is formed essentially of a plate cylinder 11 and a rubber or blanket cylinder 12, both of given unitary diameter, and of an impression cylinder 13 and a sheet turning or turnover cylinder 14, the impression and turnover cylinders 13 and 14 being double the diameter of the plate and blanket cylinders 11 and 12.

The sheet turnover or turning cylinder 14 has two rows of tongs-grippers 15 disposed diametrically opposite one another. Furthermore, the sheet-guiding surfaces of the turning cylinder 14 are formed of two removable shells 16 which are provided with coverings readily capable of delivering or transferring ink. These shells 16 are employed when processing papers. They must, however, be frequently washed so that the circumferential surfaces thereof may retain to a sufficient extent their capability of readily delivering ink. The shells 16 are removed when very stiff papers or even cardboard are being processed because no special sheet-guiding surfaces are necessary. This naturally obviates or dispenses with the need for washing the cylindrical surfaces. A substantial reduction in the unproductive or down time of the board-printing press consequently results therefrom.

The impression cylinder 13 adjoining the sheet turnover cylinder 14 also has specially constructed conventional hook-grippers 8 exactly as does the storage drum 7 to permit sheet transfer from the turnover cylinder 14, by means of the tongs-grippers 15, to the impression cylinder 13. When the cardboard-printing press is set for single side or first form printing only, the tongs-grippers 15 take over the sheets 3 by the leading edges thereof from the hook-grippers 8 of the storage drum 7. For first form and perfector printing, a turning of the sheet 3 takes place and the tongs-grippers grasp the trailing edge of the sheet 3 on the storage drum 7 which, as mentioned above, is tautened by the tensioning suckers 9, and drawn onto the turning cylinder 14.

The base frame 6 and the printing unit 10 together form the turnover or turning device. A printing unit 17 adjoining the printing unit 10 is of exactly the same construction as the printing unit 1. A printing unit 18, which is only partly shown in the figure, is also of normal conventional construction and is formed of a transfer drum 19 having triple the diameter of the plate and blanket cylinders 11 and 12, and is formed in addition to the plate cylinder 11, the rubber or blanket cylinder 12 and the impression cylinder 2 with clamping grippers 4. Accordingly, three rows of normal clamping grippers 4 are arranged in symmetrical distribution at the circumference of the transfer drum 19. The printing unit 18 of normal construction adjoining the printing unit 17 consequently has a transfer drum 19 of triple diameter.

With the printing press of the invention set for single-side multicolor printing, the press can thus apply a four-color impression both to sheets as well as to stiff cardboard. Two-side printing of the most varied kinds can be produced, depending upon the number of printing units and the arrangement of the turning or turnover devices formed of the printing unit 10 and the base frame 6. If, for example, the cardboard-printing press contains six printing units, and the third printing unit thereof corresponds to the printing unit 10, one side of the cardboard can be printing in two colors and the reverse side in four colors.

The particular advantage of the aforedescribed cardboard-printing press according to the invention is that it processes both papers as well as thicker cardboard in accurate register and smudge-free over the entire format range, even at high printing speeds. Naturally, two sheet turning or turnover devices can also be provided if necessary.

The foregoing is a description corresponding, in substance, to German application No. P 34 19 762.1, dated May 26, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Sheet-fed rotary offset printing machine having printing units arranged in tandem for processing both paper as well as cardboard with single-side multicolor or first form and perfector printing and having at least one sheet-turning device, each of the printing units having four cylinders consisting, in addition to a plate and a blanket cylinder of given diameter, of an impression cylinder and a transfer cylinder each having double the diameter of the respective plate and blanket cylinders, comprising a base frame located between two of the printing units and carrying only two cylinders consisting of a transfer cylinder and a storage cylinder, each having a diameter double that of the respective plate and blanket cylinders, the one of said two printing units located downstream of said base frame in travel direction of a sheet through the printing machine having a transfer cylinder in the form of a sheet-turning cylinder with respective rows of tongs-grippers disposed 180° from one another around the circumference thereof, said base frame and said one of said two printing units together constituting a sheet-turning device, the impression cylinder of said one of said two printing units being in cooperative engagement with said turning cylinder and having hook grippers thereon for taking over a sheet from said tongs grippers of said turning cylinder, and means disposed on the impression and turning cylinder as well as the transfer and storage cylinders for transporting the sheet smudge-free with the printed surface thereof facing radially inwardly on the cylinders.

2. Sheet-fed rotary offset printing machine according to claim 1 wherein the impression cylinder of said one of said two printing units has cylindrical surfaces conducive to transferring ink which is applied thereto.

3. Sheet-fed rotary offset printing machine according to claim 2 wherein said surfaces conducive to ink transfer are on coverings of said cylindrical surface.

4. Sheet-fed rotary offset printing machine according to claim 1 wherein the respective transfer and turning cylinders have sheet guiding surfaces conducive to transferring ink which is applied thereto.

5. Sheet-fed rotary offset printing machine according to claim 1 wherein the respective transfer and turning cylinders have sheet-guiding surfaces carrying rods and bearing elements.

6. Sheet-fed rotary offset printing machine according to claim 5 wherein said bearing elements are formed as rollers.

7. Sheet-fed rotary offset printing machine according to claim 1 wherein the respective transfer and turning cylinders have substantially unbroken sheet-guiding surfaces for directly supporting and guiding the sheet.

8. Sheet-fed rotary offset printing machine according to claim 1 wherein the respective transfer and turning cylinders have removable shells forming guide surfaces for sheets being printed.

9. Sheet-fed rotary offset printing machine having printing units arranged in tandem for processing both paper as well as cardboard with single-side multicolor or, first form and perfector printing and having at least one sheet-turning device, each of the printing units having four cylinders consisting, in addition to a plate and a blanket cylinder of given diameter, of an impression cylinder and a transfer cylinder each having at least double the diameter of the respective plate and blanket cylinders, comprising a base frame located between two of the printing units and carrying only two cylinders consisting of a transfer cylinder and a storage cylinder, each having a diameter double that of the respective plate and blanket cylinders, the one of said two printing units located downstream of said base frame in travel direction of a sheet through the printing machine having a transfer cylinder in the for of a sheet-turning cylinder with respective rows of tongs-grippers disposed 180° from one another around the circumference thereof, said base frame and said one of said two printing units together constituting a sheet-turning device, the transfer cylinder of said one of said two printing units forming part of said sheet-turning device having a diameter double the diameter of the respective plate and blanket cylinder, and the transfer cylinders of all of the other printing units of the printing machine having respective diameters triple the diameter of the respective plate and blanket cylinders, the impression cylinder of said one of said two printing units being in cooperative engagement with said turning cylinder and having hook grippers thereon for taking over a sheet from said tongs grippers of said tuning cylinder, and means disposed on the impression and turning cylinder as well as the transfer and storage cylinders for transporting the sheet smudge-free with the printed surface thereof facing radially inwardly on the cylinders.

* * * * *